US006932578B2

(12) United States Patent
Pearce

(10) Patent No.: US 6,932,578 B2
(45) Date of Patent: Aug. 23, 2005

(54) MOUNTING SYSTEM FOR SUPPORTING A CEILING FAN ASSEMBLY

(75) Inventor: Richard A. Pearce, Byhalia, MS (US)

(73) Assignee: Hunter Fan Company, Memphis, TN (US)

( * ) Notice: Subject to any disclaimer, the term of this patent is extended or adjusted under 35 U.S.C. 154(b) by 21 days.

(21) Appl. No.: 10/318,485

(22) Filed: Dec. 12, 2002

(65) Prior Publication Data

US 2004/0115061 A1 Jun. 17, 2004

(51) Int. Cl.[7] ..... F04D 29/64

(52) U.S. Cl. ..... 416/244 R; 416/246; 416/5; 248/342

(58) Field of Search ..... 416/244 R, 246, 416/5; 248/342, 343, 344

(56) References Cited

U.S. PATENT DOCUMENTS 1,496,460 A * 6/1924 Hofrichter ..... 248/343
4,448,388 A 5/1984 Dennis et al.
4,538,973 A * 9/1985 Angott et al. ..... 417/572
4,729,725 A * 3/1988 Markwardt ..... 416/244 R
4,878,806 A * 11/1989 Markwardt ..... 416/5
6,171,061 B1 * 1/2001 Hsu ..... 416/244 R

FOREIGN PATENT DOCUMENTS

JP 62271993 A * 11/1987 ..... F04D/25/08
JP 01142296 A * 6/1989 ..... F04D/25/08
JP 06088596 A * 3/1994 ..... F04D/25/08

* cited by examiner

*Primary Examiner*—Theresa Trieu
(74) *Attorney, Agent, or Firm*—Baker Donelson

(57) ABSTRACT

A mounting system (10) for supporting a ceiling fan assembly (11) of the type having a motor, motor housing (46), a plurality of blades (47) and a downrod (29) to a support surface C, which includes a mounting plate (14) coupled to a support surface C, a mounting bar (24) coupled to the mounting plate (14), a suspending hangar (28) coupled to the downrod (29), a canopy (32) journalled to the downrod (29), and screws which couple the canopy (32) to the mounting plate (14). The screws (42) permits adjustable movement of the canopy (29) between a lower position wherein the majority of the weight of the ceiling fan assembly (11) is supported by the mounting bar (24) through the suspending hangar (28) and an upper position wherein the majority of the weight of the ceiling fan assembly (11) is supported by the mounting plate (14) through the canopy (32).

20 Claims, 6 Drawing Sheets

MOUNTING SYSTEM FOR SUPPORTING A CEILING FAN ASSEMBLY

TECHNICAL FIELD

This invention relates to a mounting system for supporting a ceiling fan assembly.

BACKGROUND OF THE INVENTION

Ceiling fans have become an increasingly popular supplementary means of creating an airflow within both commercial and residential buildings. Notwithstanding the widespread use of ceiling fans, the installation of ceiling fans remains problematic.

With conventional mounting systems, the weight of the ceiling fan assembly, which includes the ceiling fan motor, motor housing, downrod, blades and blade irons, is supported by either a mounting bracket or a canopy. These mounting brackets or canopies typically include slotted openings extending from their outer edges to their centers, which are adapted to accept and retain the top end of the downrod which commonly ends in a ball joint.

When a bracket mounting system is used, the slotted mounting bracket is mounted either directly or indirectly to the ceiling at the mounting location of the anticipated connection of the ceiling fan assembly to the electrical current supply. The downrod is positioned within the slotted opening with the ball joint positioned above the slotted opening so that the downrod may be slid along the slotted opening to the mounting bracket's center and then lowered so that the ball nests upon the mounting bracket. Thus, the weight of the ceiling fan assembly is supported by the mounting bracket through the ball joint. The ceiling fan assembly is then wired to the electrical power supply wires within the ceiling. Throughout installation and wiring of the ceiling fan assembly, the canopy rests on or above the ceiling fan motor housing with the downrod extending through the center opening of the canopy. After wiring is completed, the canopy is manually raised along the downrod and is mounted to the mounting bracket to hide the mounting bracket and electrical wires from view.

When a canopy mounting system is used, the canopy is mounted either directly or indirectly to the ceiling at the mounting location of the ceiling fan assembly to the electrical current supply in much the same manner as previously described in reference to the mounting bracket. The downrod is then placed within the slotted opening of the canopy and is slid to the center of the canopy which is adapted to accept and retain the downrod ball joint. Thus, the weight of the ceiling fan assembly is supported by the canopy through the ball joint. Working through the slotted opening in the canopy, the installer wires the ceiling fan assembly to the electrical wires within the ceiling. A cover is then mounted to cover the opening and form a complete canopy.

These conventional mounting systems, however, have permitted the ceiling fan assembly to rotate during installation. As the ceiling fan assembly rotates, the electrical wires become twisted. Twisted wires are apt to break or be damaged and will require repair or replacement.

Additionally, the rotation of the ceiling fan assembly during installation makes wiring the ceiling fan assembly to the electrical wires within the ceiling more difficult. The rotation of the ceiling fan assembly during installation also lengthens the installation time because the installer must repeatedly manually rotate the ceiling fan assembly in a direction opposite to the twisting rotation in order to align the ceiling fan assembly wires with the appropriate electrical power supply wires in the ceiling.

With both bracket mounting systems and conventional canopy mounting systems, additional installation problems are common. For instance, these systems permit the installer only limited physical access through the small slotted opening to wire the ceiling fan assembly to the electrical wires in the ceiling. Furthermore, the bracket and canopy obstructs the installer's visual inspection of the wiring beyond the small slotted canopy opening. With limited physical and visual access to the wiring within the bracket or canopy, there is a noticeable increase in the difficulty of installing the ceiling fan assembly, in the time required for installation, in the possibility that wires will become damaged or broken during installation, and in the probability that the wiring connection will be faulty.

It thus is seen that a need remains for an apparatus for supporting the weight of the ceiling fan assembly and for preventing the rotation of the ceiling fan assembly during installation. Accordingly, it is to the provision of such that the present invention is primarily directed.

SUMMARY OF THE PRESENT INVENTION

In a preferred form of the invention, a mounting system for supporting a ceiling fan assembly of the type having a motor, a motor housing, a plurality of blades and a downrod to a support surface comprising a mounting bar coupled to the support surface, a mounting plate coupled to the support surface, a suspending member coupled to the downrod of the ceiling fan assembly, a canopy coupled to the downrod, and adjustable coupling means which couples the canopy to the mounting plate. The suspending member is adapted to be coupled to the mounting bar to support the weight of the ceiling fan assembly in a lower position. The adjustable coupling means permits adjustable movement of the canopy between a lower position wherein the weight of the ceiling fan assembly is supported by the mounting bar through the suspending member and an upper position wherein the weight of the ceiling fan assembly is supported by the mounting plate through the canopy.

BRIEF DESCRIPTION OF THE DRAWINGS

FIGS. 2A–4A are a series of front views of the mounting system of FIG. 1, shown in partial cross-section, which show in sequence a ceiling fan assembly being mounted to a ceiling FIGS. 2B–4B are a series of side views of the mounting system of FIG. 1, shown in partial cross-section, which show in sequence a ceiling fan assembly being mounted to a ceiling.

DETAILED DESCRIPTION OF THE PREFERRED EMBODIMENTS

Figure 1:
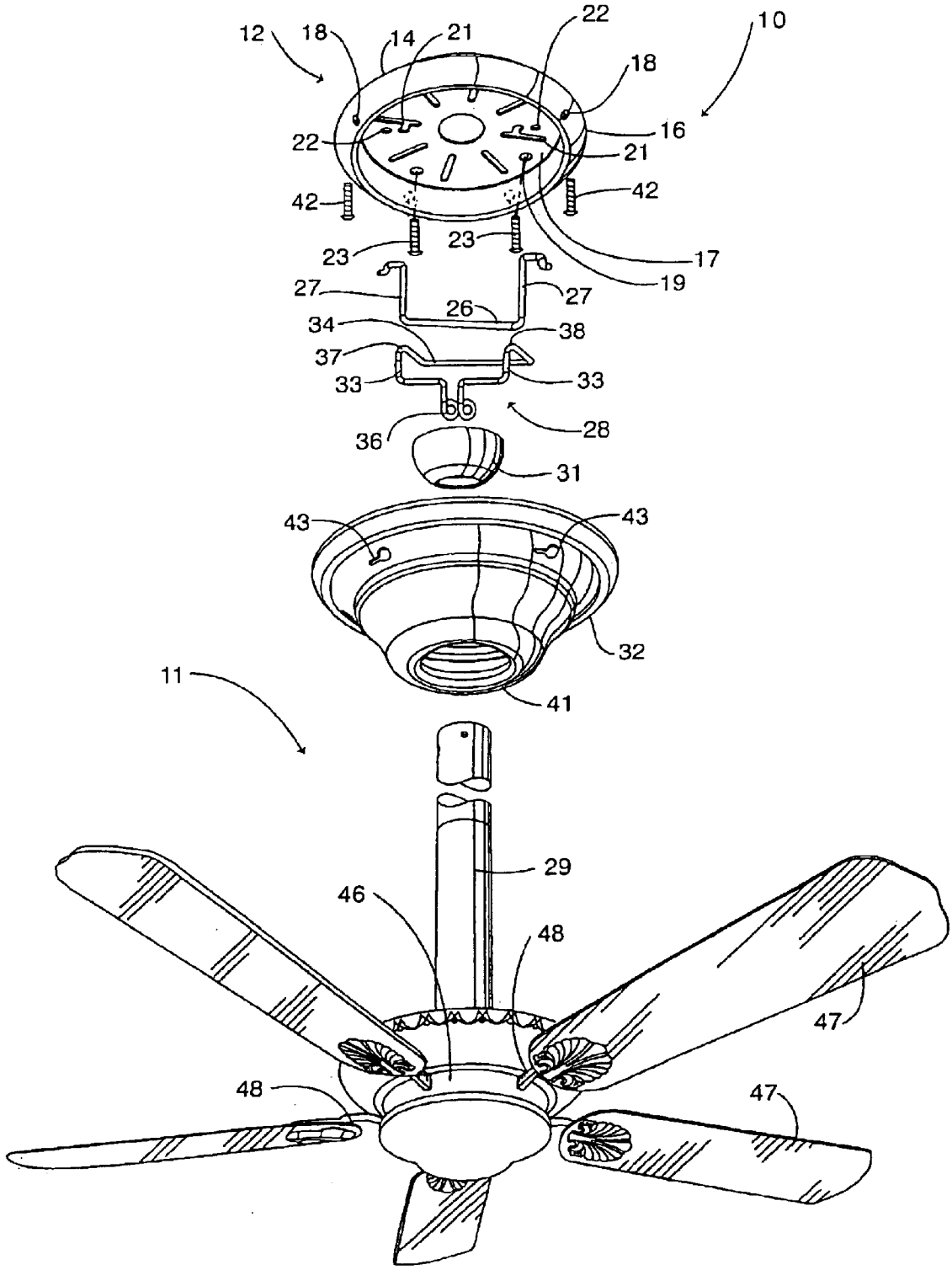
FIG. 1 is a perspective exploded view of a mounting system apparatus according to the present invention.

With reference next to the drawings, there is shown in FIG. 1 a mounting system 10 and conventional ceiling fan assembly 11 in a preferred form of the invention, shown with the mounting system 10 in an enlarged scale for clarity of explanation. The mounting system 10 includes an upper pre-mounted assembly 12 and a lower hanging assembly 13. The upper pre-mounted assembly 12 includes a mounting plate 14 having a peripheral, annular flange 16 extending from a generally planar central portion 17. The annular flange 16 has an annular array of four threaded mounting holes 18 therein. The central portion 17 has an annular array of four mounting holes 19, two key slots 21 and two locking holes 22 adjacent the key slots 21. The pre-mounted assembly 12 also includes four mounting screws 23 sized and shaped to pass through the mounting holes 19 within the central portion 17 and into the ceiling C, and a U-shaped mounting bar 24 having a generally horizontal member 26 extending between two leg members 27 each of which is mounted within a key slot 21 and a locking hole 22 of the central portion 17.

The lower hanging assembly 13 includes a catch or suspending hanger 28, a downrod 29 coupled to a ball joint 31, and a canopy 32 journalled upon the downrod 29. The suspending hanger 28 has a pair of legs 33 joined together by a cross member 34. The legs 33 of the suspending hangar 28 have a lower, looped portion 36 and an upper portion 37 having a bight 38. The suspending hanger 28 is adapted to be coupled to and suspended from the mounting bar 24 and is pivotably mounted to the downrod 29 through a pivot pin 39 journalled through the looped portion 36 and mounted within the upper end of the downrod 29. The downrod 29 has the ball joint 31 fixed to its upper end and the ceiling fan assembly 11 coupled to its lower end. The canopy 32 includes a central, beveled flange 41 adapted to receive and nest the ball joint 31 therein. The lower hanging assembly 13 also includes four screws 42 adapted to extend through four corresponding key-hole type mounting holes 43 in the canopy 32 and be threadably received within the four corresponding threaded mounting holes 18 in the mounting plate flange 16.

The ceiling fan assembly 11 has an unshown motor 44, a motor housing 46, fan blades 47, and blade irons 48. The ceiling fan motor extends through an opening at the lower end of the motor housing 46. The ceiling fan blades 47 are coupled to blade irons 48 which are in turn coupled to the motor at pre-determined locations depending on the desired number of fan blades 47. Although the ceiling fan assembly 11 is shown in the preferred embodiment with five blades 47, any number of fan blades 47 may be used as dictated by convention. Thus, rotational motion produced by the motor will produce air circulation through rotational movement of the fan blades 47. In order to control the speed of rotation of the fan blades 47, the motor has an unshown control switch which can be controlled conventionally through actuation of a pull string or electrical controller.

In use, the upper pre-mounted assembly 12 is installed by mounting the mounting plate 14 to the ceiling C by extending the four screws 23 through the screw holes 19 in the mounting plate 14 and threading the screws 23 into the ceiling C or ceiling joists. The mounting bar 24 is then coupled to the mounting plate 14 by inserting the mounting bar leg members 27 into the mounting plate key slots 21 and rotating the mounting bar 24 counter-clockwise until leg members 27 are received by the mounting plate locking holes 22.

Figure 2A:
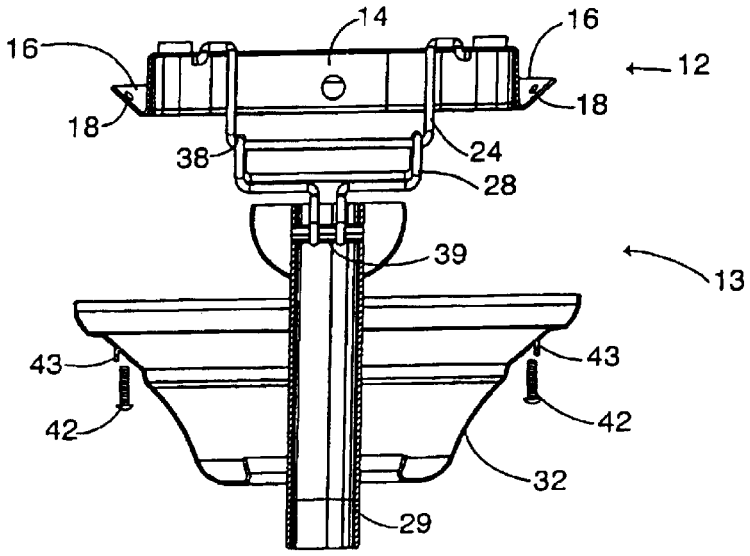
Figure 2B:
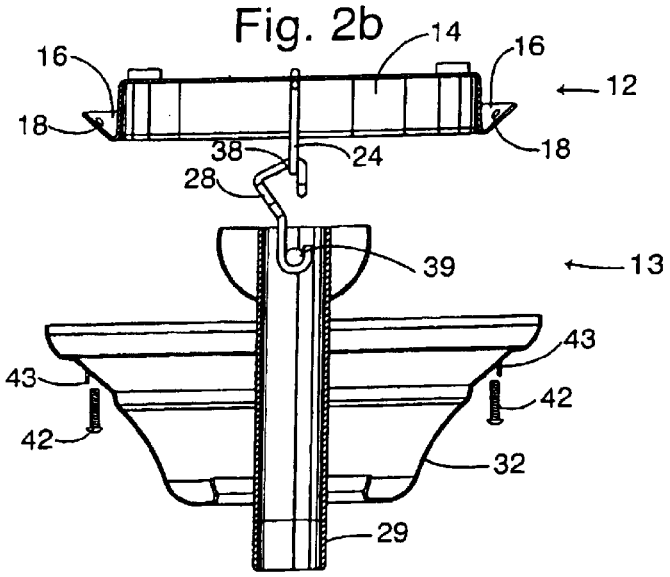

As shown in FIGS. 2A and 2B, the lower hanging assembly 13 is then suspended from the upper pre-mounted assembly 12 by positioning the mounting bar 24 within the bight 38 of the suspending hangar 28. When initially mounting the suspending hangar 28 onto the mounting bar 24, the canopy 32 is journalled upon the downrod 29 in a rested position upon the motor housing 46. When the canopy 32 is in a lowered position, the suspending hangar 28 supports the majority of the weight of the ceiling fan assembly 11 and the ceiling fan assembly 11 is prevented from rotating. The ceiling fan assembly 11, specifically the unshown electric wires associated with the electric motor, is then wired to the electrical wires in the ceiling. It should be noted that the installer may couple the wires without lifting the ceiling fan assembly 11 or maintaining the relative position of the ceiling fan assembly 11.

Figure 3A:
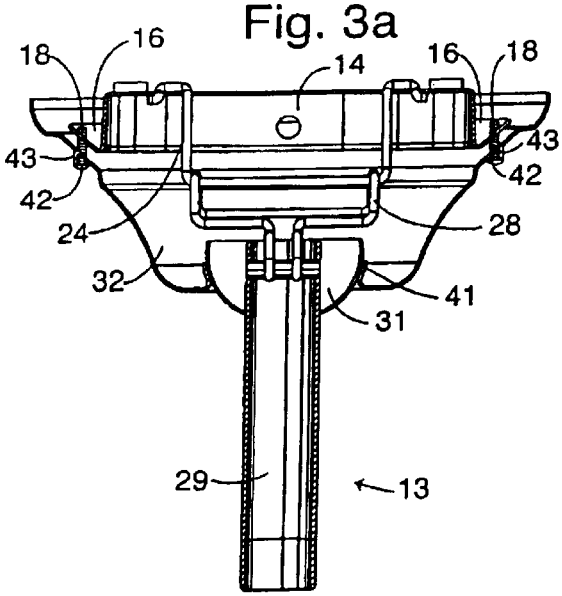
Figure 4A:
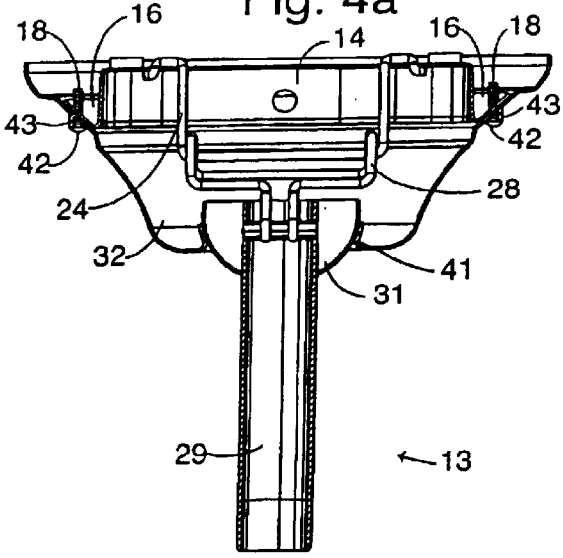
Figure 3B:
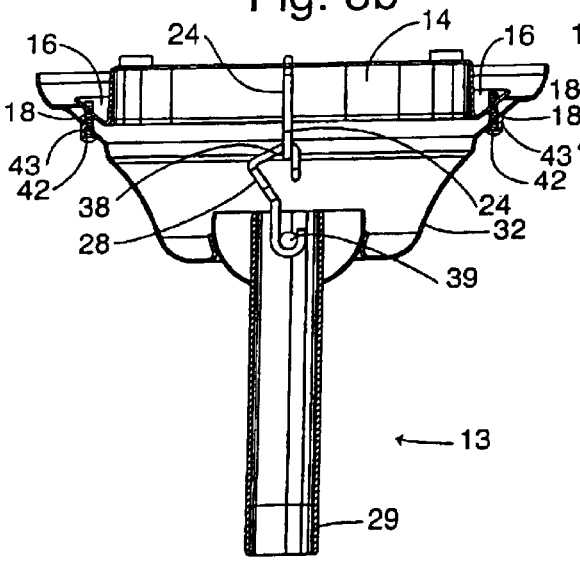
Figure 4B:
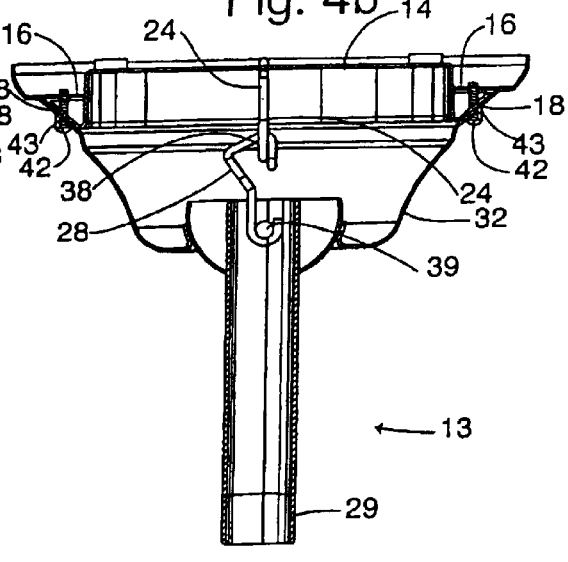

Next, the canopy 32 is raised along the downrod 29 to a position generally below and adjacent the mounting plate 14. With the four threaded screws 42 mounted within the four threaded screw holes 18 in the mounting plate flange 16 the canopy is raised so that the heads of the screws 42 pass through the large portion of the key-hole type mounting holes 43. The canopy is then rotated clockwise so that the heads of the screws 42 are positioned in the narrow portion of the mounting holes 43 to prevent the canopy from falling, as shown in FIGS. 3A and 3B. As the threaded screws 42 are-threaded further into the mounting plate flange 16, the lower hanging assembly 13 and the adjoining ceiling fan assembly 11 are raised from a lower position to an upper, final mounting position wherein the majority of the weight of the ceiling fan assembly 11 is transferred from the coupling of the suspending hangar 28 with the mounting bar 24 to the nesting of the ball joint 31 with the flange 41 of the canopy 32, as shown in FIGS. 4A and 4B. As the weight of the ceiling fan assembly 11 is transferred to the canopy 32, the suspending hanger 28 may pivot with the legs 27 of the suspending hanger 28 resting against the mounting bar 24. Once the screws 42 passing through the canopy 32 are fully received into the mounting plate flange 16, the ceiling fan assembly 11 is in its final mounting position and the ceiling fan assembly 11 is stabilized for use.

It should be understood that the present invention allows for an installer to momentarily relieve the weight of the fan assembly 11 from himself during an interim step prior to permanently mounting the ceiling fan assembly 11 to the ceiling. Additionally, the mounting bar 24 and the suspending hanger 28 prevent the rotation of the downrod 29 and ceiling fan assembly 11 during mounting and operation. Should the ceiling fan assembly 11 be removed from the ceiling C, the screws 42 are simply unthreaded thereby causing the suspending hangar 28 to once again receive the mounting bar 24 within its bight 38. The operator may then simply lift the suspending hangar 28 over the mounting bar 24 to completely separate the ceiling fan assembly 11 from the ceiling C.

It should be understood that as an alternative to the threaded screws 42, received by the flange 16, other drawing means could be employed to raise the canopy 32, such as a threaded canopy 32 threadably received by the mounting plate 14. It should also be understood that although the preferred embodiment depicts screws 23, 42 as a fastening or drawing means, other means such as bolts, latches, clasps, locks or clamps may be used. It should further be understood that means such as a hook, hitch, or clip may be utilized as an alternative suspending hangar 28. Although the preferred embodiment depicts four threaded screws 42 extending through four canopy holes 43 and threadably received by four threaded screw holes 18 in the mounting plate flange 16, any number of screws and corresponding screw holes may be used without departing from the scope of the invention. It should further be understood that although the ceiling fan assembly 11 is shown with five blades 47, any number of fan blades 47 may be used as dictated by convention.

Figure 5:
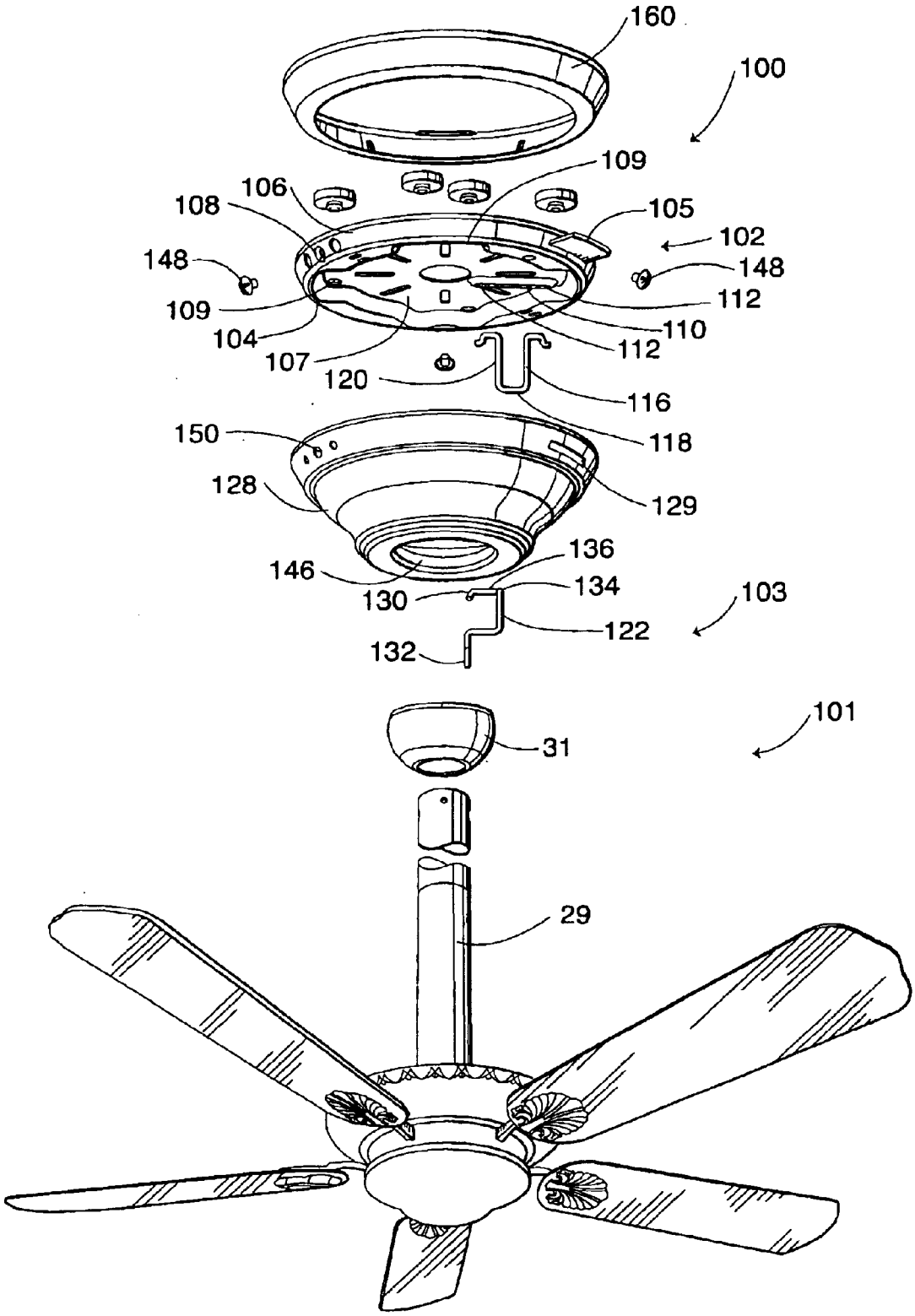
FIG. 5 is a perspective exploded view of an alternate embodiment of a mounting system apparatus according to the present invention.

FIG. 5 illustrates an alternate embodiment of amounting system apparatus 100 and conventional ceiling fan assembly 101 according to the present invention, shown with the mounting system 100 in an enlarged scale for clarity of explanation. As with the primary embodiment, the alternative embodiment consists of an upper pre-mounted assembly 102 and a lower hanging assembly 103. The pre-mounted assembly 102 has a mounting plate 104 with a generally planar central portion 107. The central portion 107 has two key slots 110 and two locking holes 112 adjacent the key slots 110. Four unshown mounting screws are sized and shaped to pass through an annular array of four mounting holes 109 within the central portion 107 and into the ceiling. A U-shaped mounting bar 116 has two leg members 120 joined by a generally horizontal member 118. Each of the leg members 120 is mounted within a key slot 110 and a locking hole 112 of the central portion 107. The mounting plate 104 also has an annular flange 106 that extends from the central portion 107 with an annular array of three threaded mounting holes 108 and a L-shaped tab 105 which extends generally outward from the flange 106.

The lower hanging assembly 103 includes a suspending or hanging member 122, a downrod 29 coupled to a ball joint 31, and a canopy 128 coupled upon the downrod 31. The hanging member 122 has a lower arm 130 with a lower, looped portion 132 and an upper curved portion 134. A generally horizontal member 136 extends from the curved portion 134 generally perpendicular to the lower arm 130. The hanging member 122 is adapted to be coupled to and suspended from the mounting bar 116. The hanging member 122 is pivotably mounted to the downrod 29 by a pivot pin 144 journalled through the looped portion 132 and mounted within the upper end of the downrod 29. The downrod 29 has the ball joint 31 fixed to its upper end and the ceiling fan assembly 101 coupled to its lower end.

The canopy 128 includes a central, beveled flange 146 adapted to receive and nest the ball joint 126 therein. Three screws 148 are adapted to extend through three corresponding mounting holes 150 in the canopy 128 and be threadably received within the three corresponding threaded mounting holes 108 in the mounting plate flange 106. A slot 129 extends into the canopy 128 and is adapted to receive the mounting plate tab 105. The mounting system apparatus 100 may also include a decorative annular covering ring 160 sized and shaped to mate with the top portion of the canopy 128.

In substantially the same manner as that of the ceiling fan assembly 11 illustrated in FIG. 1, the ceiling fan assembly 101 in FIG. 5 has an unshown motor, a motor housing 46, fan blades 47, and blade irons 48. The ceiling fan motor extends through an opening at the lower end of the motor housing 46. The ceiling fan blades 47 are coupled to blade irons 48 which are in turn coupled to the motor. By convention, an unshown control switch can control the speed of rotation of the fan blades 47 through actuation of a pull string or electrical controller.

In use, the mounting plate 104 is mounted to the ceiling C by extending the four unshown screws through the screw holes 109 in the mounting plate 104 and threading the screws into the ceiling C. The mounting bar 116 is then coupled to the mounting plate 104 by inserting the mounting bar leg members 120 into the mounting plate key slots 110 and expanding the mounting bar 116 until leg members 120 are received by the mounting plate locking holes 112.

Figure 6:
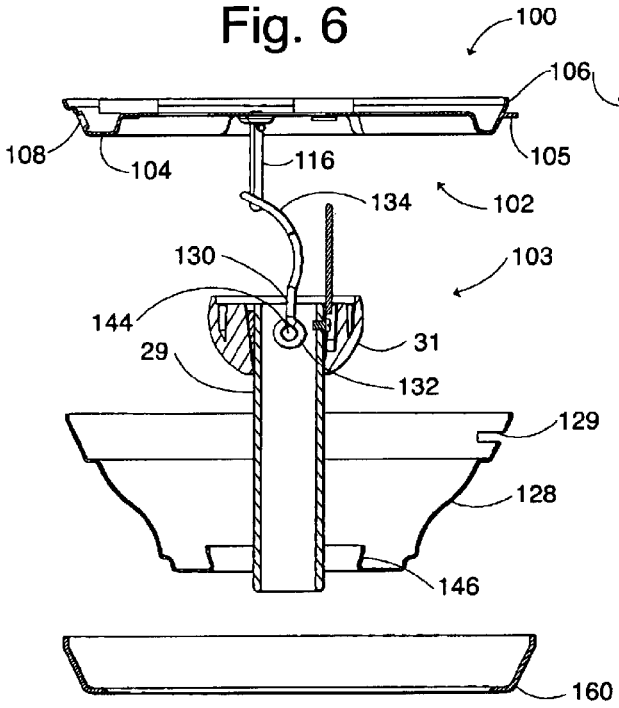
FIGS. 6–8 are a series of front views of the alternate embodiment of the mounting system of FIG. 5, shown in partial cross section, which show in sequence a ceiling fan assembly being mounted to a ceiling.
Figure 7:
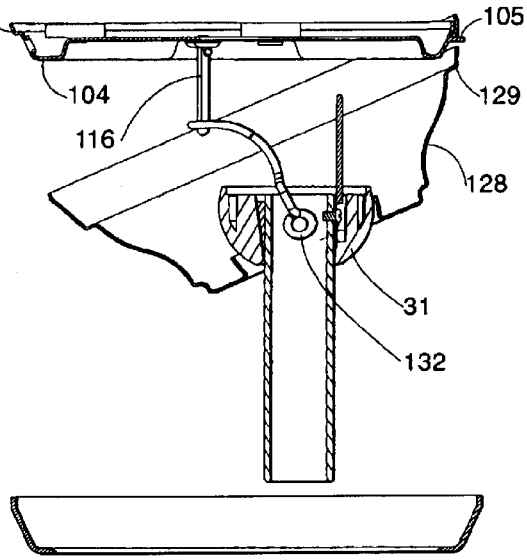
Figure 8:
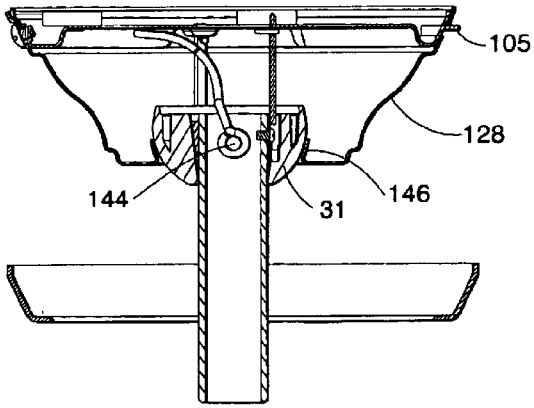

As shown in FIGS. 6–8, the lower hanging assembly 103 is coupled to the upper pre-mounted assembly 102 by inserting the mounting plate tab 105 into the slot 129 in the canopy 128. The hanging member 122 is suspended from the mounting bar 116 by positioning the horizontal member 118 of the mounting bar 116 within the hooking portion of the hanging member 122 defined by horizontal member 136 and curved portion 134. During suspension, the canopy 128 is journalled upon the downrod 124 and the ceiling fan assembly 11 is prevented from rotating. The ceiling fan assembly 101 is then wired to the electrical wires in the ceiling without the user having to lift the ceiling fan assembly 101 or maintain the relative position of the ceiling fan assembly 101.

Once the wiring is completed, the side of the canopy 128 distal the slot 129 is pivotally raised about the tab 124 to a position generally below and adjacent to the mounting plate 104 and the three threaded screws are mounted within the three mounting holes 109. The lower hanging assembly 103 and the adjoining ceiling fan assembly 101 are thus raised from a lower position to an upper, final mounting position. During this process the majority of the weight of the ceiling fan assembly 101 is transferred from the coupling of the tab 105 with the slot 129 and the hanging member 122 with the mounting bar 116 to the nesting of the ball joint 126 within the flange 148 of the canopy 128. As the weight of the ceiling fan assembly 101 is transferred to the canopy 128, the hanging member 122 may pivot with the horizontal bar 136 of the hanging member 122 resting upon the mounting bar 116. The ceiling fan assembly 101 is in its final mounting position and the ceiling fan assembly 101 is stabilized for use once the screws 148 passing through the canopy 128 are fully received into the mounting plate flange 106. The covering ring 160 may then be raised and positioned over the top portion of the canopy in order to hide the screws, tab and slot. The covering ring may be mounted to the canopy in any conventional fashion.

The ceiling fan assembly 101 maybe removed from the ceiling C in substantially the same manner as the ceiling fan assembly 11 of the first embodiment. The screws 148 are simply unthreaded thereby causing the hanging member 122 to again receive the mounting bar 116 within its hooking portion of horizontal member 136 and curved portion 134. The operator may then lift the hanging member 122 over the mounting bar 116 to completely separate the ceiling fan assembly 101 from the ceiling C.

The mounting bar 116 in combination with the hanging member 122 prevents the rotation of the downrod 29 and ceiling fan assembly 101 during mounting and operation and allows for an installer to momentarily relieve the weight of the fan assembly 101 from himself during an interim step prior to permanently mounting the ceiling fan assembly 101 to the ceiling. It should be understood that although the preferred embodiment depicts screws 148 as a fastening or drawing means, other means such as bolts, latches, clasps, locks or clamps may be used.

Figure 9:
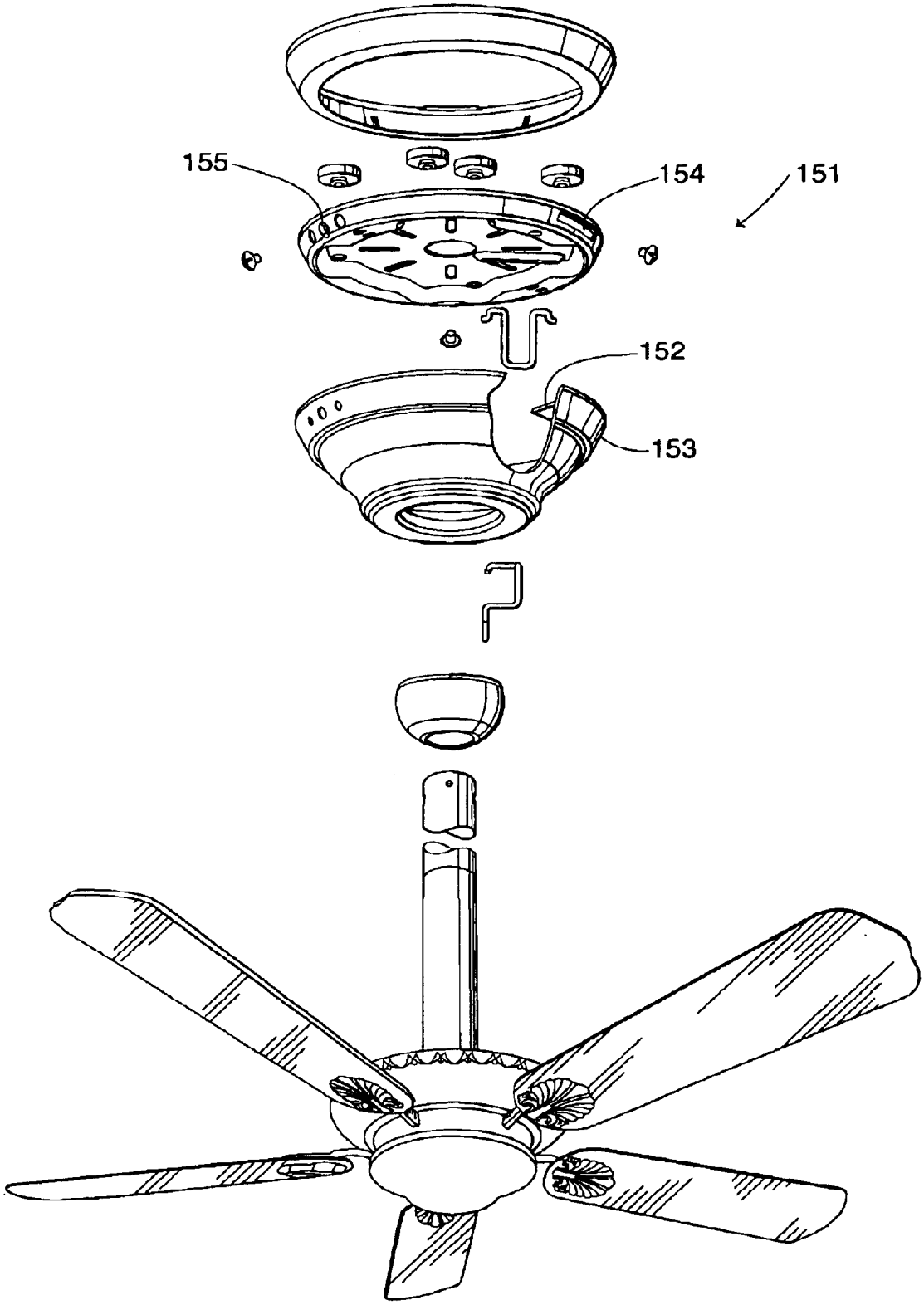
FIG. 9 is side view of a third embodiment of the mounting system according to the present invention, which shows a ceiling fan assembly being mounted to a ceiling.

In a third alternative embodiment, the ceiling fan assembly 151 depicted in FIG. 9 is essentially the same as the ceiling fan assembly 101 of the second embodiment, the only difference being that in this embodiment the tab 152 extends generally inward from the canopy 153 and is received in a slot 154 that extends into the mounting plate 155, i.e., the relative positions of the tab and slot relative to the canopy and mounting plate are reversed.

It thus is seen that a mounting system for supporting a ceiling fan assembly is now provided. It should be understood that many modifications may be made to the specific preferred embodiment described herein without departure from the spirit and scope of the invention as described by the following claims.

What is claimed is:

1. A mounting system for supporting a ceiling fan assembly of the type having a motor, motor housing, a plurality of blades and a downrod to a support surface, the mounting system comprising;

a. coupling means for initially coupling the ceiling fan assembly to a support surface and supporting the weight of the ceiling fan assembly, said coupling means including a mounting bar and a catch removably coupled to said mounting bar;

b. a canopy coupled to the downrod of the ceiling fan assembly and adapted to support the weight of the ceiling fan assembly; and c. drawing means for drawing the canopy from an initial, lower mounting position wherein the coupling means supports the majority of the weight of the ceiling fan assembly to a final, upper mounting position wherein the canopy supports, the majority of the weight of the ceiling fan assembly while relieving the majority of the weight from the coupling means, said drawing means comprises a plate coupled to the support surface, said plate having a tab, and a slot extending into the canopy, whereby said slot is adapted to receive said tab;

whereby an operator couples the ceiling fan assembly to the support surface when mounting the ceiling fan assembly to the support surface and subsequently transfer the weight of the ceiling fan assembly to the canopy while raising the ceiling fan assembly to stabilize the ceiling fan assembly for use.

2. The mounting system of claim 1, wherein said mounting bar is coupled to said downrod.

3. The mounting system of claim 2, wherein said hanging member is a catch.

4. The mounting system of claim 3, wherein said catch is pivotably coupled to said downrod.

5. The mounting system of claim 1, wherein A mounting system for supporting a ceiling fan assembly of the type having a motor, motor housing, a plurality of blades and a downrod to a support surface, the mounting system comprising;

a. coupling means for initially coupling the ceiling fan assembly to a support surface and supporting the weight of the ceiling fan assembly, said coupling means including a mounting bar and a catch removably coupled to said mounting bar;

b. a canopy coupled to the downrod of the ceiling fan assembly and adapted to support the weight of the ceiling fan assembly: and c. drawing means for drawing the canopy from an initial, lower mounting position wherein the coupling means supports the majority of the weight of the ceiling fan assembly to a final, upper mounting position wherein the canopy supports the majority of the weight of the ceiling fan assembly while relieving the majority of the weight from the coupling means, said drawing means comprises a slot extending into a mounting plate and tab extending from said canopy and whereby said slot is adapted to receive said tab;

whereby an operator couples the ceiling fan assembly to the support surface when mounting the ceiling fan assembly to the support surface and subsequently transfer the weight of the ceiling fan assembly to the canopy while raising the ceiling fan assembly to stabilize the ceiling fan assembly for use.

6. The mounting system of claim 1, wherein said coupling means comprises a mounting bar coupled to the support surface and a hanging member coupled to the downrod of the ceiling fan assembly.

7. The mounting system of claim 6, wherein said hanging member is pivotably mounted to said downrod.

8. A mounting system for supporting a ceiling fan assembly of the type having a motor, motor housing, a plurality of blades and a downrod coupled to a support surface, comprising:

(a) a mounting plate coupled to the support surface;

(b) a mounting bar coupled to the mounting plate;

(c) a suspending hook-shaped catch coupled to the downrod of the ceiling fan assembly, said suspending hook-shaped catch being adapted to be removably coupled to said mounting bar to support the weight of the ceiling fan assembly in a lower position;

(d) a canopy coupled to the downrod; and (e) adjustable coupling means for coupling said canopy to said mounting plate for adjustable movement of said canopy between a lower position wherein the weight of the ceiling fan assembly is supported by said mounting bar through said suspending hook-shaped catch and an upper position wherein the weight of the ceiling fan assembly is supported by said mounting plate through said canopy, said adjustable couplings means comprises a plate coupled to the support surface, said plate having a tab, and a slot extending into the canopy, whereby the slot is adapted to receive said tab, whereby an operator couples the suspending hook-shaped catch to the mounting bar when initially mounting the ceiling fan assembly to the support surface and subsequently transfer the weight of the ceiling fan assembly to the canopy while raising the ceiling fan assembly to stabilize the ceiling fan assembly for use.

9. The mounting system of claim 8, wherein said adjustable coupling means comprises at least one threaded screw extending from said canopy and threadably received by said mounting plate.

10. The mounting system of claim 9, wherein said suspending hook-shaped catch is pivotably coupled to said downrod.

11. The mounting system of claim 8, wherein said adjustable coupling means further comprises at least one threaded screw extending from said canopy and threadably received by said mounting plate.

12. A mounting system for supporting a ceiling fan assembly of the type having a motor, motor housing, a plurality of blades and a downrod coupled to a support surface, comprising:

(a) a mounting plate coupled to the support surface;

(b) a mounting bar coupled to the mounting plate;

(c) a suspending hook-shaped catch coupled to the downrod of the ceiling fan assembly, said suspending hook-shaped catch being adapted to be removably coupled to said mounting bar to support the weight of the ceiling fan assembly in a lower position;

(d) a canopy coupled to the downrod; and (e) adjustable coupling means for coupling said canopy to said mounting plate for adjustable movement of said canopy between a lower position wherein the weight of the ceiling fan assembly is supported by said mounting bar through said suspending hook-shaped catch and an upper position wherein the weight of the ceiling fan assembly is supported by said mounting plate through said canopy, said adjustable coupling means comprises a slot extending into a mounting plate and tab extending from said canopy and whereby said slot is adapted to receive said tab, whereby an operator couples the suspending hook-shaped catch to the mounting bar when initially mounting the ceiling fan assembly to the support surface and subsequently transfer the weight of the ceiling fan assembly to the canopy while raising the ceiling fan assembly to stabilize the ceiling fan assembly for use.

13. The mounting system of claim 12, wherein said adjustable coupling means further comprises at least one threaded screw extending from said canopy and threadably received by said mounting plate.

14. A mounting system for supporting a ceiling fan assembly of the type having a motor, motor housing, a plurality of blades and a downrod to a support surface, comprising:

(a) a mounting plate coupled to the support surface;

(b) a horizontal mounting bar coupled to the mounting plate;

(c) a hanging hook member coupled to the downrod of the ceiling fan assembly, said hanging hook member being adapted to be removably coupled to said mounting bar to support the weight of the ceiling fan assembly in a lower position;

(d) a canopy coupled to the downrod; and (e) adjustable coupling means for coupling said canopy to said mounting plate, said adjustable coupling means comprises a tab extending from the mounting plate and a slot extending into the canopy whereby said slot is adapted to receive said tab, whereby an operator couples the hanging hook member to the mounting bar when initially mounting the ceiling fan assembly to the support surface and subsequently transfer the weight of the ceiling fan assembly to the canopy after raising and stabilizing the ceiling fan assembly for use.

15. The mounting system of claim 14, wherein said adjustable coupling means further comprises at least one threaded screw extending from said canopy and threadably received by said mounting plate.

16. The mounting system of claim 15, wherein said hanging member is pivotably coupled to said downrod.

17. A mounting system for supporting a ceiling fan assembly of the type having a motor, motor housing, a plurality of blades and a downrod to a support surface, comprising:

(f) a mounting plate coupled to the support surface;

(g) a horizontal mounting bar coupled to the mounting plate;

(h) a hanging hook member coupled to the downrod of the ceiling fan assembly, said hanging hook member being adapted to be removably coupled to said mounting bar to support the weight of the ceiling fan assembly in a lower position;

(i) a canopy coupled to the downrod; and (j) adjustable coupling means for coupling said canopy to said mounting plate, said coupling means comprises a tab extending from the canopy and a slot extending into the mounting plate whereby said slot is adapted to receive said tab, whereby an operator couples the hanging hook member to the mounting bar when initially mounting the ceiling fan assembly to the support surface and subsequently transfer the weight of the ceiling fan assembly to the canopy after raising and stabilizing the ceiling fan assembly for use.

18. The mounting system of claim 17, wherein said adjustable coupling means further comprises at least one threaded screw extending from said canopy and threadably received by said mounting plate.

19. A mounting system for supporting a ceiling fan assembly of the type having a motor, motor housing, a plurality of blades and a downrod to a support surface, comprising:

(a) a mounting plate having a mounting bar;

(b) a catch coupled to said downrod;

(c) a canopy journalled upon said downrod;

(d) a tab extending from the canopy;

(e) slot extending into the mounting plate and adapted to receive said tab; and (f) at least one threaded screw extending from said canopy to said mounting plate so as to raise said canopy from a lower position wherein the weight of the ceiling fan assembly is supported by said mounting plate through said tab and said mounting bar through said catch and an upper position wherein the weight of the ceiling fan assembly is supported by said mounting plate through said canopy, whereby an operator inserts the tab into the slot and couples the catch to the mounting bar when initially mounting the ceiling fan assembly to the support surface and subsequently transfer the weight of the ceiling fan assembly to the canopy while raising the ceiling fan assembly to stabilize the ceiling fan assembly for use.

20. A mounting system for supporting a ceiling fan assembly of the type having a motor, motor housing, a plurality of blades and a downrod to a support surface, comprising:

(a) a mounting plate having a mounting bar;

(b) a catch coupled to said downrod;

(c) a canopy journalled upon said downrod;

(d) a slot extending into said canopy;

(e) a tab extending from said mounting plate and adapted to be received in said slot; and (f) at least one threaded screw extending from said canopy to said mounting plate so as to raise said canopy from a lower position wherein the weight of the ceiling fan assembly is supported by said mounting plate through said tab and said mounting bar through said catch and an upper position wherein the weight of the ceiling fan assembly is supported by said mounting plate through said canopy, whereby an operator inserts the tab into the slot and couples the catch to the mounting bar when initially mounting the ceiling fan assembly to the support surface and subsequently transfer the weight of the ceiling fan assembly to the canopy while raising the ceiling fan assembly to stabilize the ceiling fan assembly for use.

* * * * *